US007188757B2

(12) United States Patent
Hein et al.

(10) Patent No.: US 7,188,757 B2
(45) Date of Patent: Mar. 13, 2007

(54) EXPANDER ROLLER ARRANGEMENT FOR THE WRINKLE-FREE GUIDANCE OF WEBS

(75) Inventors: Stefan Hein, Blankenbach (DE); Gunter Klemm, Nidda (DE); Wolfgang Klein, Worth (DE)

(73) Assignee: Applied Materials GmbH & Co. KG, Alzenau (DE)

( * ) Notice: Subject to any disclaimer, the term of this patent is extended or adjusted under 35 U.S.C. 154(b) by 0 days.

(21) Appl. No.: 11/083,066

(22) Filed: Mar. 16, 2005

(65) Prior Publication Data

US 2005/0211821 A1 Sep. 29, 2005

(30) Foreign Application Priority Data

Mar. 26, 2004 (EP) ..... 04007324

(51) Int. Cl.
*B65H 20/00* (2006.01)

(52) U.S. Cl. ..... 226/192; 26/102

(58) Field of Classification Search ..... 226/190, 226/191, 192, 194; 26/102, 104; 384/471
See application file for complete search history.

(56) References Cited

U.S. PATENT DOCUMENTS 2,817,940 A * 12/1957 Lorig ..... 226/192
2,925,640 A * 2/1960 Morrow ..... 26/102
3,666,049 A * 5/1972 Kern et al. ..... 26/104
3,804,473 A * 4/1974 Barrett ..... 26/104
3,913,813 A * 10/1975 Morse ..... 226/21
3,951,480 A * 4/1976 Nicholson ..... 384/473
5,226,870 A 7/1993 Smith et al.

FOREIGN PATENT DOCUMENTS

DE 36 13 494 A 11/1987
EP 0 829 654 A 3/1998

* cited by examiner

*Primary Examiner*—Emmanuel Marcelo
*Assistant Examiner*—Evan H. Langdon
(74) *Attorney, Agent, or Firm*—Fulbright & Jaworski L.L.P.

(57) ABSTRACT

An expander roller for the wrinkle-free guidance of webs in closed chambers comprises two stationary supporting bodies (7, 8) which are oriented with respect to one another at an obtuse angle in the proximity of a center plane (E—E). On both sides of the center plane (E—E) on the supporting bodies (7, 8) are disposed roller sections (12) with surfaces in the form of truncated cones with shell lines (M1, M2) and which during their rotation pass through positions in which said shell lines (M1, M2) are aligned with one another. The surfaces (12*a*) of the rollers are herein steplessly in line one with the other in succession and the rollers are supported via roller bearings in groups (10, 11) on the two supporting bodies (7, 8). To reduce speed differences when taking off the webs, to avoid scratches on the webs and to improve the precision of guidance and smoothness of operation, the rollers on both sides of the center plane (E—E) are each comprised of at least two roller sections (12) rotatable independently of one another. Before aerating the vacuum chamber, in the method for operation a gas is introduced into the bearing region through which solid bodies from the group dust and particles are blown out of the bearing region and solid bodies are prevented from penetrating into the bearing region.

13 Claims, 3 Drawing Sheets

EXPANDER ROLLER ARRANGEMENT FOR THE WRINKLE-FREE GUIDANCE OF WEBS

This application claims priority from EP Patent Application No: 04 007 324.9-1256 filed Mar. 26, 2004, herein incorporated by reference in its entirety.

The invention relates to an expander roller arrangement.

BACKGROUND AND SUMMARY OF THE INVENTION

For the better understanding of prior art and the invention reference is made to the fact that all shell surfaces of rotational solids, be they cylindrical, conical or rotational solids of other shapes, have an infinite number of shell lines. The following singled-out linear shell lines M1 and M2 are selected defined positions of the shell lines which lie on a common straight line, are aligned with one another and through which all shell lines traverse successively during the rotation.

U.S. Pat. No. 3,666,049 discloses an expander roller for webs, in which on a stationary arcuate tube a series of cylindrical sleeves axially spaced apart are pivoted by means of roller bearings. These sleeves, in turn, are encompassed by a flexible tubing, which also functions as a seal between the sleeves. Due to the curvature of the arcuate tube, each sleeve has its own rotational axis. As a consequence and relative to fixed reference points of the sleeves, their distances change periodically during the rotation, such that considerable fulling-action occurs within the tubing, which also tends to local displacements on the sleeves with the formation of frictional forces. Since driving the roller takes place through the particular web, considerable tensile stresses occur on it, such that the application—as specified—is limited to high tensile strength webs of textiles, felt and the like. All surface elements of the tubing rotate at the same rotational speed, such that by necessity during the spreading force-consuming circumferential and longitudinal displacements occur of portions of the web on the roller. The document substantially also discusses the lubrication of the bearings by oil mist, which is sprayed into the interspaces between the bearings. However, the individual parts and their assembling are complex and for the purpose of dismantling and maintenance the tubing must be pulled off.

DE 27 25 331 C2 discloses a similar banana-shaped expander roller for webs, which electively can be embodied with or without a jacket of rubber or synthetic material. Each sleeve is only supported at one end by means of a roller bearing on the arcuate tube and with the other is connected with the particular adjacent sleeve via an elastic bushing, such that all sleeves rotate at the same rotational speed and circumferential speed. This document also deals substantially with the lubrication of the bearings by oil mists injected into the interspaces between the bearings. The individual parts and their assembling are, however, complex, and, for the purpose of dismantling and maintenance, the jacket must possibly be pulled off and the sleeves be separated from the elastic bushings.

DE 36 13 494 A1 discloses a similar banana-shaped expander roller for webs, in which, however, the issue concerns the monitoring of the temperature of the roller bearings.

DE 37 33 448 A1 discloses a similar banana-shaped expander roller for webs, in which the issue concerns continuously lubricating the roller bearings of the individual sleeves with grease. Relubricating such rollers is also dealt with in DE 39 19 415 C2.

The principal disadvantages of all "banana rollers" are that the entire surface, be that a tubing or jacket of elastomeric materials, be they cylindrical sleeves in the form of metallic sections of tubes, does not at any site contain or form a straight shell line, and specifically neither on the run-in side nor on the run-out side of the web. Furthermore, the tangential deviation of the jackets or sleeves increases in the direction toward the two ends of the expander roller such that there is the risk of an overstretching the web edges, which cannot be reversed.

EP 0 470 331 B1 discloses inter alia two alternative expander rollers for the simplification of fabrication and assembling, of which the one comprises an arcuate support for outer bushings and the other a straight-line support. In the case of the arcuate support the roller bearings are pivoted directly on such, in the straight-line support by interposing inner bushings with cylinder extensions whose outer faces form an acute angle with the support axis. While at similarly oriented angular position of all inner bushings at two sites a straight-line shell line is generated, viewed transversely to it; however, a sawtooth-form surface profile is generated, with which the web is in intimate contact. In sensitive web material this causes tracks which can no longer be compensated, even through the spreading.

EP 0 527 291 B1 discloses an expander roller with straight-line support, on which several disk-form bushings or rollers with cylindrical circumferential surfaces are disposed. Only the central one of these rollers is precisely perpendicular to the axis of the support, all others are settable hereunto at an acute angle mirror-symmetrically and in groups. However, due to the numerous pivot axes and the associated adjustment mechanisms, the installation and assembling are complex.

DE 199 01 089 A1 according to the species discloses developing an expander arrangement for webs of two truncated cones, whose smallest diameters are oriented toward one another and of which one shell line each is aligned with that of the other truncated cone. When the margins of the web run up onto the thicker ends of the truncated cones, these are stretched, and the web is pulled off from these shell lines in the tangential direction. While such truncated cones have over their entire length the same rotational speed or angular speed, they do not have the same circumferential speed such that, with the exception of its edges, the web is pulled off while being dragged or with slippage from the shell lines of the truncated cones. When pulling off sensitive webs, such as for example thin synthetic material films, these speed differences lead to the formation of scratches, which cannot be eliminated. A further disadvantage is that the ends of the support bodies directed toward one another have a significant distance from one another, i.e. they are not connected with one another, which has a negative effect on the stability of the three-dimensional form and the guidance properties.

EP 0 829 654 A2 discloses arranging in an expander roller to dispose two groups of truncated cone-form rollers on a continuously curved axis. The lesser diameters of the rollers are in the center and their greater diameters—starting from the center—face the outer sides. The production of suitable and reproducible curvatures by bending is extremely difficult. The same applies to the production of basis fitting rollers in accordance with the geometry of the axis. However, unsatisfactory are primarily the fits between the inner bearing rings and the axle. These bearing rings must have a greater diameter than the axle, resulting in the risk of a deviation of the rollers on the axle. All rollers are connected through pins and radial slots, such that, while they rotate with one another and have the same rotational speed, they do however have different circumferential speeds. The result can be that the margin regions of the transported web are displaced faster than the central regions, whereby depending on the frictional factors and the thinness of the guided webs other irregularities can occur during the winding. Due to differing slippage of the web on the expander roller are also generated different driving forces. However, as a rule, an expander roller should be driven by the film, i.e. it should be "towed" with minimum friction.

U.S. Pat. No. 2,925,640 discloses a continuous self-supporting axle only curved angularly in the center, whose straight-line shanks extend from a center piece. On each of these shanks is pivoted a truncated cone-form roller. Between the two truncated cones is disposed a wedge-shaped stationary ring, which is fastened by means of a bracket on a support and whose uppermost shell line is aligned in succession with the adjacent shell lines of the truncated cones. The film or the web must thereby slide over a partial circumference of this stationary ring, whereby again braking effects, scratches and/or path diversions are generated, which are avoided by the invention. Further, through the ring are guided two revolving pins which synchronize the rotational speeds of the two truncated cones. The stationary ring cannot support the axle since the revolving pins do not allow a strut.

The invention therefore has as its aim improving an expander roller arrangement of the above described species to the effect that, in spite of highly simple structuring of the expander roller arrangement, said speed difference is the least feasible when the webs are pulled off, that the development of scratches on the webs does not occur, or is at least negligible, and that the precision of guidance and smoothness of running are improved.

The defined aim is achieved according to the invention in the expander roller arrangement described herein.

Through these constructional measures the defined aim is achieved to its full extent, i.e. said speed difference during the pulling-off of the webs is the least feasible, in spite of the highly simple structuring of the expander roller arrangement, the development of scratches on the webs does not occur, or is at least negligible, and the precision of guidance and smoothness of running are improved. In particular the initial tendency to wrinkle forming, which can be "towed through" a full winding, is successfully counteracted. This is of particular importance in the case of thin webs, for example in the form of synthetic films.

As a rule, the expander roller arrangement precedes at least one treatment or coating station, in particular a coating roller, which transports the web or the webs through the at least one treatment or coating station.

In the course of further formations of the invention it is especially advantageous, if either singly or in combination:

- the closed chamber is a vacuum chamber with at least one treatment station for the webs, in particular, if the treatment station is a coating station for the webs,
- each group of roller sections is comprised of at least four roller sections,
- the supporting bodies are provided with longitudinal bores and radial bores, through which an oil-containing gas can be introduced between two roller bearings each,
- the supporting bodies are embodied as hollow cylinders,
- the two supporting bodies are connected with one another by a coupling element in the region of the center plane,
- the coupling element includes an annular flange with two flat side faces, which form an acute angle with one another and from which project two threaded connection fittings in the direction of the normal, onto which are screwed the supporting bodies,
- the coupling element has a throughbore for the connection of the longitudinal bores in the supporting bodies,
- the bores in the supporting bodies are connected to a lubricant source, through which a lubricant can be added to the supplied gas,
- the surfaces of the groups of roller sections disposed on both sides of the center plane are each located in a common truncated cone surface,
- the surfaces of the individual roller sections are comprised of a light metal,
- the surfaces of the individual roller sections have a distance of 0.05 to 1 mm on the circumference and in the axial direction,
- the axes of the supporting bodies are oriented at an angle of 0.1 to 2 degrees with respect to one another,
- the roller bearings are retained at a specified distance through spacer rings and if the roller sections are retained at a distance by inner flanges between the outer rings of two roller bearings, and/or if
- the expander roller arrangement is retained between two parallel chamber walls.

To prevent contaminations within the guide rollers and their bearings, it is proposed that, before aerating the vacuum chamber, a gas is introduced into the interspace or the interspaces, through which solid bodies from the group dust and particles are blown out of the interspace and the penetration of solid bodies into the interspace is prevented.

If the roller bearings include inner and outer rings, it is especially advantageous if the gas is blown through the annular gap between the inner rings and the outer rings, in particular, if the gas during the entire aerating process of the vacuum chamber is supplied through the roller interior.

In the following an embodiment example of the subject matter of the invention, its operational function and advantages will be explained in greater detail in conjunction with FIGS. 1 to 3.

DETAILED DESCRIPTION

Figure 1:
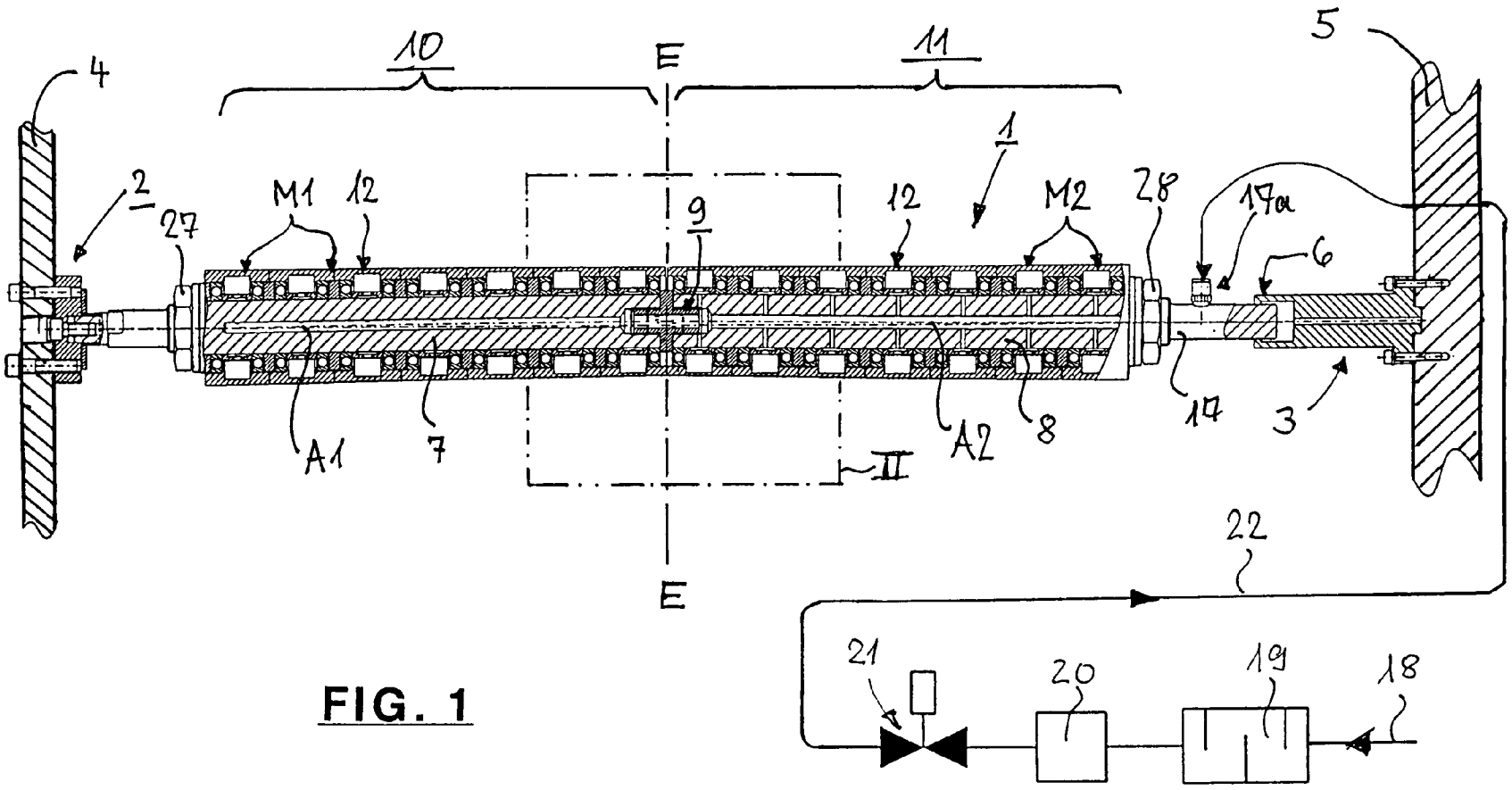
FIG. 1 an axial section through an expander roller arrangement disposed between two side walls of a vacuum chamber, FIG. 2 a cutout from the frame II in FIG. 1 at a highly enlarged scale, and FIG. 3 several feasibilities of web guidance over the expander roller arrangement according to FIGS. 1 and 2.

FIG. 1 depicts an expander roller arrangement 1, which is retained by means of two mountings 2 and 3 on the inner sides of two parallel perpendicular chamber walls 4 and 5 of an otherwise not further depicted vacuum chamber. A position compensation, which may occur through temperature changes of the roller arrangement and/or pressure changes at the chamber walls 4 and 5, is compensated via a slide guidance 6.

The expander roller arrangement 1 includes two tubular supporting bodies 7 and 8, which at their ends remote from the walls are connected with one another in a center plane E—E through a coupling element 9, such that they are positionally secure. On these supporting bodies 7 and 8 are supported two groups 10 and 11, each of seven roller sections 12 with rotationally symmetrical surfaces 12*a*, developed as circular truncated cone surfaces and disposed steplessly arrayed in series with one another. The particular smaller circumferential circles of the top surface in each group 10 or 11 are directed toward the center plane E—E, the particular greater circumferential circles of the base surfaces are in each group 10 or 11 oriented toward the chamber walls 4 or 5. The shell lines M1 and M2, which in FIG. 1 are the topmost lines, are linearly aligned and form a common take-down line L for a web 13 (see FIG. 3). This presupposes that the axes A1 and A2 of both groups 10 and 11 form an acute angle of, for example, 0.8 degrees with one another.

Figure 2:
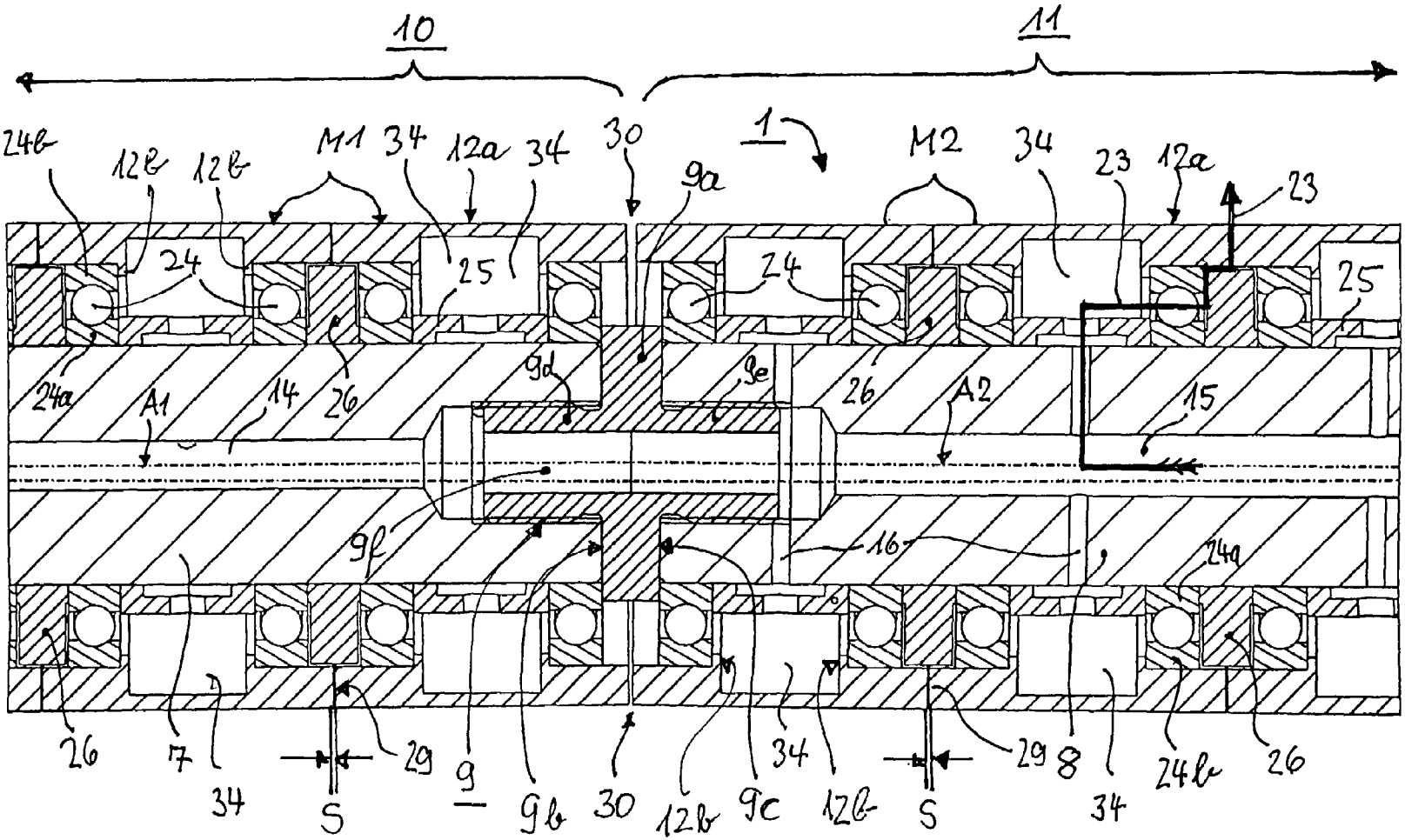

The supporting bodies 7 and 8 have concentric longitudinal bores 14 or 15, respectively, from which radial bores 16 lead to the individual roller bearings, which in FIG. 2 is shown in greater detail only for the right group 11 of the roller sections 12. However, this applies also to the left group 10. The right longitudinal bore 15 leads to a tubular piece 17, which is also hollow and comprises a lateral connection element 17*a*. The explanation for this is as follows:

For the purpose of a web change, the vacuum chamber must be aerated to ambient pressure, which, for the purpose of saving time, takes place through an aeration valve with large cross section. Even if a dust filter is associated with this valve, dust settled in some locations is nevertheless swirled up through the strong air current. This dust also tends to penetrate into the expander roller arrangement and to block its bearings, such that more frequent disassembling and cleaning of the expander roller arrangement are necessary. Especially hazardous is the formation of zinc dust occurring during the coating of webs with zinc. In the presence of oxygen this zinc dust forms zinc oxide, which becomes settled in the bearings as well as also in gaps.

The invention is capable of counteracting this in the following manner: before the stand-down phase, i.e. before the start of venting and before the vacuum chamber is opened, ambient air 18 is supplied in small quantities via a filter 19, a lubricant source 20 (for example an oil nebulizer) and a setting or dosing valve 21 as well as a conduit 22 to the connection element 17*a*. These small quantities are just sufficient for the next web treatment cycle. One of these flow paths for the oil mist is indicated in FIG. 2 by a line 23. Pressure and dosing are matched such that at least the major portion of the oil remains in the roller bearings.

This has the additional advantage that the air, supplied to the expander roller arrangement during the aerating of the chamber, prevents the dust and other particles from penetrating into the expander roller arrangement. The lubricant addition can at the same time also be interrupted or the lubricant source can be circumvented.

Utilizing the previously applied reference symbols, FIG. 2 shows the following: the coupling element 9 is comprised of an annular flange 9*a* with two flat side faces 9*b* and 9*c*, from each of which in the direction of the normal projects one threaded connection fitting 9*d* and 9*e*. The side faces 9*b* and 9*c* form with each other the same acute angle of for example 0.8 degrees as the axes A1 and A2. Onto the threaded connection fittings 9*d* and 9*e* are screwed the tubular supporting bodies 7 and 8 until they abut the side faces 9*d* and 9*e*. Thereby the assembly of coupling element 9 and supporting bodies 7 and 8 form a positionally secure bearing unit resistant to bending for the two groups 10 and 11 of the roller sections 12 and the linear alignment of the shell lines M1 and M2. The coupling element 9 has a throughbore 9*f* for the connection of the longitudinal bores 14 and 15.

Onto said assembly of coupling element 9 and supporting bodies 7 and 8 is slid from both ends a series arrangement of roller bearings 24 with inner races 24*a* and outer races 24*b*, perforated spacer rings 25 of lesser outer diameters and non perforated spacer rings 26 of greater outer diameters and tightened against one another with nuts 27 and 28 (FIG. 1). The roller sections 12 are each pivoted on two roller bearings 24 such that they are resistant to displacement and specifically through radially inwardly directed inner flanges 12*b*, which are laterally in contact on the outer races 24*b* of the roller bearings 24. Apart from the inner diameters of the spacer rings 26, their side walls are outwardly set back stepwise, and the outer diameter is less than that of the outer races 24*b*, such that on the outer circumference of the stationary spacer rings 26 no contact with adjacent rotating structural parts, in particular with the roller sections 12, is possible.

The axial dimensions are so made that between the roller sections 12 annular gaps 29 with gap widths "s" of, for example, 0.2 mm are formed, which enables relative rotational movements between the individual roller sections 12. With reference to oppositely disposed imaginary fixed points of the two immediately adjacent roller sections 12 of both groups 10 and 11 in the proximity of the coupling element 9, said fixed points move in such manner that the width of a gap 30 in the proximity of the coupling element 9 during the rotation fluctuates for example periodically between 0.89 mm (in FIG. 2 below) and 1.53 mm (above). The linear alignment of the shell lines M1 and M2 is unchanged during the rotation of the roller sections. Of importance here is that through this bridge-like structuring the circumferential speed of the roller sections 12 in the proximity of their shell lines M1 and M2 is identical on both sides of the coupling element 9.

During operation the roller sections 12 of both groups 10 and 11, due to the bridge formation of the assembly of coupling element 9 and the supporting bodies 7 and 8, rotate at absolutely the same circumferential speed, whereby slippage and frictional movements of the web on the conical roller sections 12 in the circumferential direction are reduced to a minimum. These local slippage and frictional movements decrease further with increasing number of roller sections 12 per unit length of the expander roller arrangement 1.

Through the disposition in series of roller sections 12 and their roller bearings 24 and spacer rings 25 and 26, relative to the supporting bodies 7 and 8 one continuous interspace 34 is formed, which is blown free and kept free by the introduction of gas.

Figure 3:
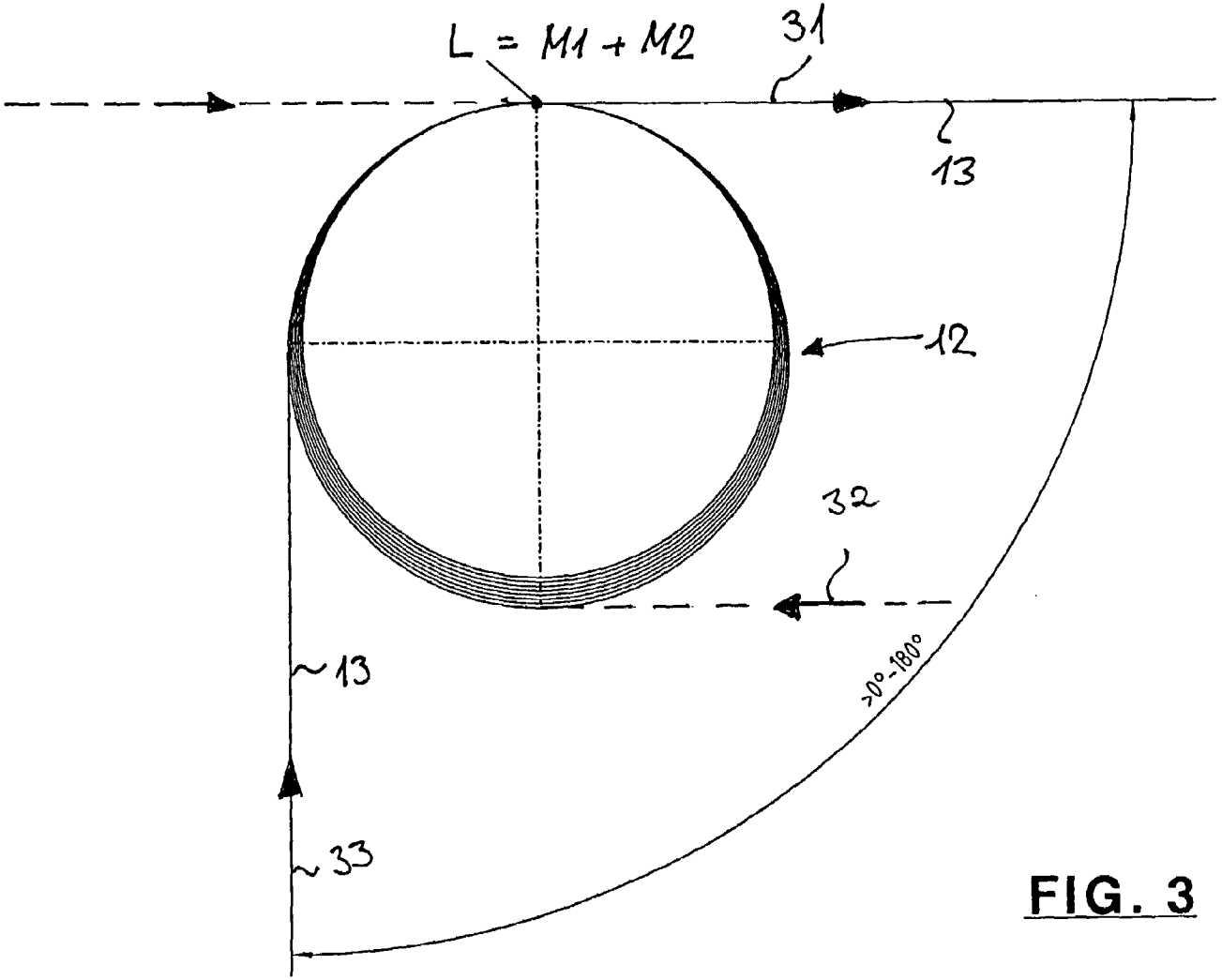

FIG. 3 illustrates several feasibilities for web guidance over the expander roller arrangement according to FIGS. 1 and 2. Shown are the base circles of the individual roller sections, whose linearly aligned shell lines M1 and M2 are located on a common line L, which extends perpendicularly to the plane of drawing and is here only indicated by a point. From this straight line L the web 13 is pulled off in the direction of arrow 31. The arc of contact can be varied between 0 and 180 degrees in order to affect the degree of spreading. If the web 13 is supplied in the direction of the hereunto parallel arrow 32, a maximum spreading results. An intermediate value of the spreading is attained if the web is supplied at right angles, i.e. in the direction of arrow 33.

It is claimed:

1. An expander roller arrangement for the wrinkle-free guidance of webs in closed chambers comprising two stationary cylindrical supporting bodies, which are connected at an obtuse angle with respect to one another through a coupling element in the proximity of a center plane (E—E) and with rollers, disposed thereon rotatably on roller bearings on both sides of the center plane (E—E), which have the form of truncated cone surfaces with shell lines (M1, M2) and which during their rotation about the supporting bodies pass through positions in which said shell lines (M1, M2) are aligned with one another, the surfaces of the rollers being disposed steplessly in line one with the other in succession, and the rollers being pivoted via roller bearings on the two supporting bodies in groups wherein the rollers on both sides of the center plane (E—E) each comprise at least two roller sections, surfaces of each group of roller sections being located in a common truncated cone surface and each of the roller sections being rotatable independently of one another, wherein the coupling element includes an annular flange with two flat side faces, which form an acute angle with one another and from which project two threaded connection fittings onto which are screwed the supporting bodies.

2. The expander roller arrangement as claimed in claim 1, wherein each group of roller sections is comprised of at least four roller sections.

3. The expander roller arrangement as claimed in claim 1, wherein the supporting bodies are provided with longitudinal bores and radial bores through which an oil-containing gas can be introduced between two roller bearings in each instance.

4. The expander roller arrangement as claimed in claim 1, wherein the cylindrical supporting bodies are embodied as hollow cylinders.

5. The expander roller arrangement as claimed in claim 2, wherein the surfaces of the individual roller sections comprise a metal.

6. The expander roller arrangement as claimed in claim 1, wherein the coupling element has a throughbore for the connection of longitudinal bores in the supporting bodies.

7. The expander roller arrangement as claimed in claim 3, wherein the bores in the supporting bodies are connected to a lubricant source, through which a lubricant can be added to the supplied gas.

8. The expander roller arrangement as claimed in claim 1, wherein the surfaces of the individual roller sections comprise a metal.

9. The expander roller arrangement as claimed in claim 1, wherein the surfaces of the individual roller sections on the circumference in the axial direction have a distance of 0.05 to 1 mm.

10. The expander roller arrangement as claimed in claim 1, wherein axes (A1, A2) of the supporting bodies are oriented with respect to one another at an angle of 0.1 to 2 degrees.

11. The expander roller arrangement as claimed in claim 1, wherein the roller bearings are retained at a specified spacing by spacer rings and that the roller sections are retained at a spacing by inner flanges between the outer races of two roller bearings each.

12. The expander roller arrangement as claimed in claim 1, wherein the expander roller arrangement is retained between two parallel chamber walls.

13. The expander roller arrangement as claimed in claim 1, wherein the roller bearings include inner races and outer races and that a gas is introduced through annular gaps between the inner races and the outer races.

* * * * *